United States Patent [19]

Shaver

[11] Patent Number: 4,883,269

[45] Date of Patent: Nov. 28, 1989

[54] ATTACHMENT FOR EXERCISE BENCH

[76] Inventor: Conroy Shaver, P.O. Box 284, Bengough, Saskatchewan, Canada, 50C 0K0

[21] Appl. No.: 192,250

[22] Filed: May 9, 1988

[51] Int. Cl.[4] ..... A63B 21/06

[52] U.S. Cl. ..... 272/117; 272/134

[58] Field of Search ..... 272/117, 118, 134, 143, 272/144, 130

[56] References Cited

U.S. PATENT DOCUMENTS

| | | | |
|---|---|---|---|
| 3,120,954 | 2/1964 | Apostol | 272/117 |
| 3,834,694 | 9/1974 | Pridgen | 272/131 X |
| 3,912,263 | 10/1975 | Yatso | 272/118 |
| 3,917,262 | 11/1975 | Jalkeld | 272/134 X |
| 4,183,520 | 1/1980 | Chase | 272/134 X |
| 4,407,495 | 10/1983 | Wilson | 272/134 X |
| 4,422,636 | 12/1983 | De Angeli | 272/134 X |
| 4,470,596 | 9/1984 | Desiderio | 272/134 X |
| 4,509,746 | 4/1985 | Mask | 272/117 X |
| 4,546,968 | 10/1985 | Silberman | 272/117 |
| 4,598,908 | 7/1986 | Morgan | 272/117 X |
| 4,641,833 | 2/1987 | Trethewey | 272/130 X |
| 4,690,133 | 9/1987 | George | 272/117 X |
| 4,696,469 | 9/1987 | Elder | 272/117 X |
| 4,732,380 | 3/1988 | Maag | 272/134 X |
| 4,768,778 | 9/1988 | Thomas, Jr. | 272/143 X |

FOREIGN PATENT DOCUMENTS

| | | | |
|---|---|---|---|
| 2717373 | 10/1978 | Fed. Rep. of Germany | 272/117 |

*Primary Examiner*—Richard J. Apley
*Assistant Examiner*—Robert W. Bahr
*Attorney, Agent, or Firm*—Murray E. Thrift; Stanley G. Ade; Adrian D. Battison

[57] ABSTRACT

An exercise apparatus comprises a conventional weight bench with a leg curl attachment at one end. The leg curl attachment includes either one or two L-shaped arms pivotally attached to one end of the bench. The arm sections that project downwardly in the at rest position carry weights while the other arm sections project from the end of the bench in the at rest position and are pivotally connected to one end of a tension link. The other end of the tension link carries a cross bar that engages the legs just above the knees to exercise the stomach during leg raises.

12 Claims, 4 Drawing Sheets

FIG. 1 (PRIOR (ART)

ATTACHMENT FOR EXERCISE BENCH

FIELD OF THE INVENTION

The present invention relates to exercise equipment and more particularly to weight training equipment for exercising the stomach muscles.

BACKGROUND

Conventional exercises for the stomach muscles include sit-ups and leg lifts. Multiple repetitions and the recommended performance of sit ups in association with a partner make these exercises unacceptable to many persons.

Appliances used for exercises of this sort include spring devices, rope and pulley systems and rubber tubing. These are all based on the leg raise and sit-up exercises and suffer from many of the same disadvantages. In addition, the exercises carried out with these devices are not specifically intended to exercise the stomach muscles. Sometimes only the the upper stomach muscles are developed. This has a negative effect in that it produces a rounded upper stomach.

Weight training can show the most rapid and thorough results, but to exercise the stomach specifically, several different exercises are required, with as much time and risk as some of the non-weight methods.

SUMMARY

The objective of the present invention is to provide an economic exercising apparatus that can be used for weight training the stomach muscles.

According to the present invention, there is provided an exercise apparatus comprising:

- a bench;
- at least one arm pivotally mounted on an end of the bench for pivotal movement upwardly from an at rest position projecting substantially horizontally from the end of the bench;
- means for resisting the upward pivoting movement of the arm;
- a tension link connected to the arm at a position spaced from the end of the bench for free pivotal movement with respect to the arm; and
- a link crossbar connected to the link remote from its connection to the arm.

The apparatus may be provided as a tension link attachment for a conventional weight bench with a leg curl accessory. The tension link attaches to the horizontal arm of the curl accessory.

The stomach is exercised using a leg lift in which the user lies supins on the bench with the link crossbar engaged by the legs just above the knee.

The legs are raised about the hips.

In another upper body exercise that can be performed with some embodiments of the invention, the user lies supine on the bench, head towards the attachment. The crossbar is grasped with the hands and pulled over the head towards the hips. The movement in both the arm pull-over and the leg lift is a horizontal movement that acts, through the tension link to pivot the horizontal arm upwardly. The exercises performed are two-way exercises, with effort being required in both the contraction and extension phases.

It is preferred that the bench is provided with a belt attachment for restraining the waist of the wearer against the bench to keep the back supported and flat on the bench surface.

An apparatus of this sort may be used to provide a good cardio vascular activity. In exercising the stomach, few repetitions are needed as weights may be added to the leg curl part of the apparatus to provide the required resistance to muscle contraction. In the same way, adjustment of the weight applied to the leg curl accessory will suit the apparatus for persons of different fitness and strengths.

BRIEF DESCRIPTION OF THE DRAWINGS

In the accompanying drawings, which illustrate a prior art exercise bench and an exemplary embodiment of the present invention.

DETAILED DESCRIPTION

Figure 1:
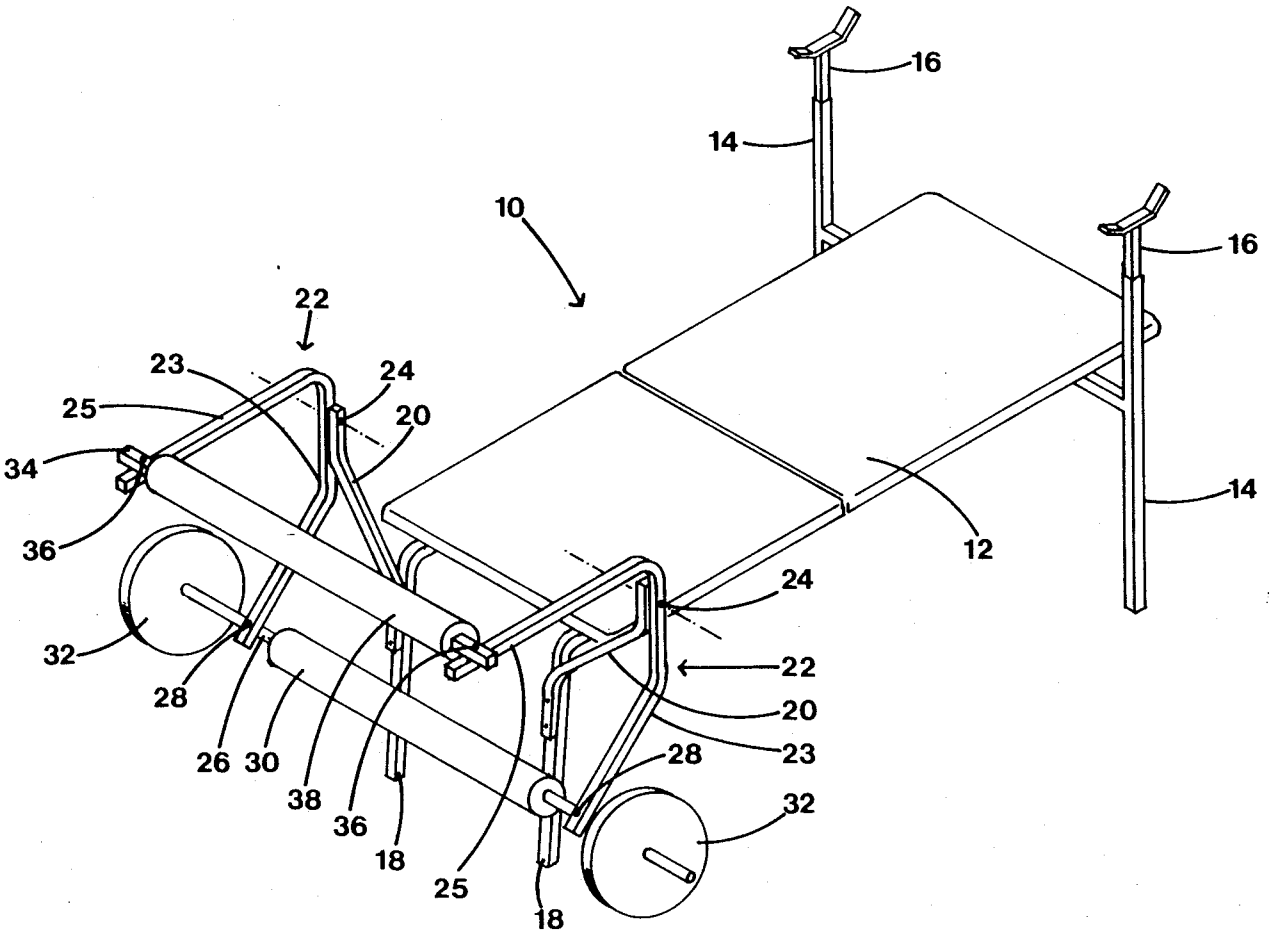
FIG. 1 is an isometric view of a prior art exercise bench with a leg curl accessory.

Referring to FIG. 1, there is illustrated a prior art weight training bench 10 consisting of a bench top 12 supported at one end by two legs 14 that also carry adjustable bar supports 16 in the conventional way. At the other end of the bench are two legs 18 that support the bench and also carry brackets 20 that are fixed to the legs and have upper ends offset outwardly to the opposite sides of the bench. Near their upper ends, the brackets 20 are connected to a pair of generally L-shaped arms 22 by pivot pins 24 that are aligned on a common axis X—X laterally of the bench. In the at rest position illustrated in FIG. 1, each of the arms 22 has a part 23 that projects downwardly from the pivot 24 and a second part 25 that projects substantially horizontally from the end of the bench at a level slightly higher than the bench top.

Near the ends of the first parts 23 of the arms, there is a crossbar 26 that extends across the arms and is bolted to the them by bolts 28. The centre section of this crossbar carries a tubular pad 30, while its ends project beyond the arms to carry weights 32. At the outer ends of the arm parts 25, there is a second crossbar 34 that is connected to the arms by bolts 36. The centre section of the crossbar 34 is also provided with a tubular pad 38.

A bench of the type illustrated in FIG. 1 is conventional in nature and may be used for carrying out a number of exercises, including various leg curls using the curl accessory consisting of the brackets 20, arms 22 and the crossbars 26 and 34.

Figures 2, 2A:
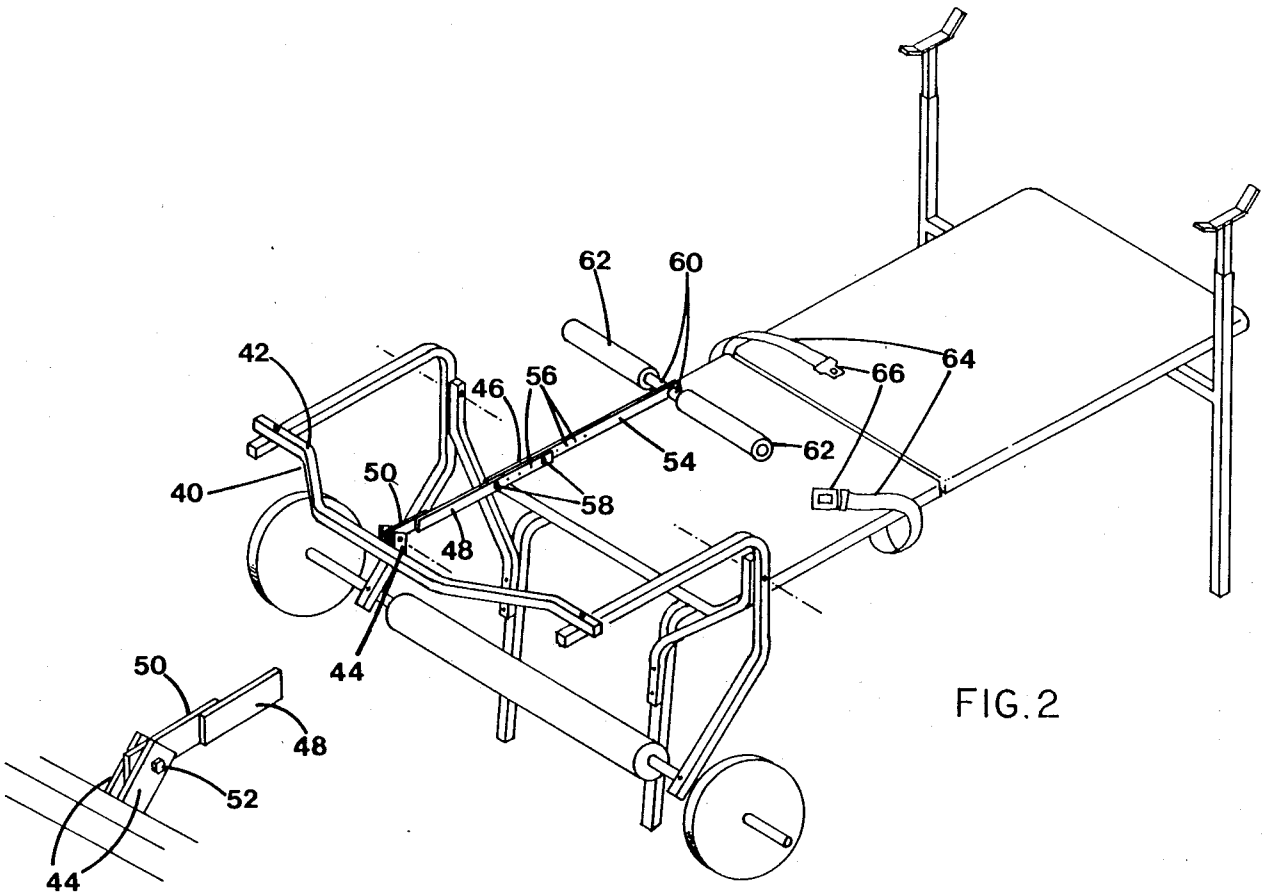
FIG. 2 is an isometric view of the apparatus of FIG. 1 modified by the incorporation of an apparatus according to the present invention.
FIGS. 2A is a detail of FIG. 2.

Referring to FIG. 2, there is illustrated an attachment according to the present invention that is associated with a bench such as that illustrated in FIG. 1. The attachment includes an upper crossbar 40 that replaces the crossbar 34 of the prior art structure. This has an offset centre section 42 offset in a direction away from the adjacent end of the bench. The centre section carries a pair of legs 44 that slope upwardly out of the plane of the offset centre section. A tension link 46 is connected to the lugs 44. The tension link includes a bar section 48 with an offset end 50 projecting between the lugs and connected to them by a pin 52. The pin is readily removed without the use of tools so that the attachment is readily removed when desired. This can be achieved with the use of a wing nut or a spring clip retainer. A second bar section 54, aligned with the offset end 50 of the bar section 48 is connected to the first bar section through the use of aligned holes 56 in the bar sections and bolts 58 through the aligned holes. This system allows the adjustment of the length of the tension link as desired to suit different exercises and different users.

The end of the tension link 46 remote from the crossbar 40 carries a crossbar 60 that projects to opposite sides of the link and carries two tubular pads 62 on opposite sides of the link.

The bench is also equipped with a waist belt 64 that is fastened to the bench in any suitable way and may be closed by any suitable buckle mechanism 66.

Figure 3:
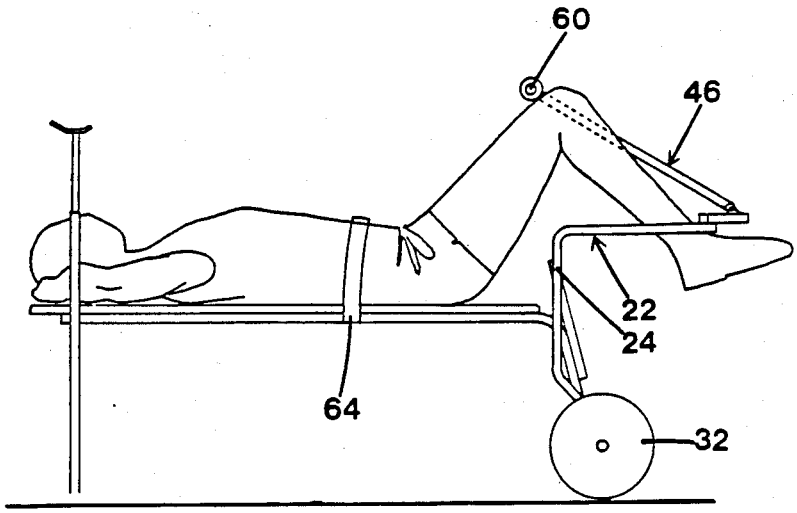
FIGS. 3 and 4 are schematic side elevations showing the use of the present apparatus in leg raises.
Figure 4:
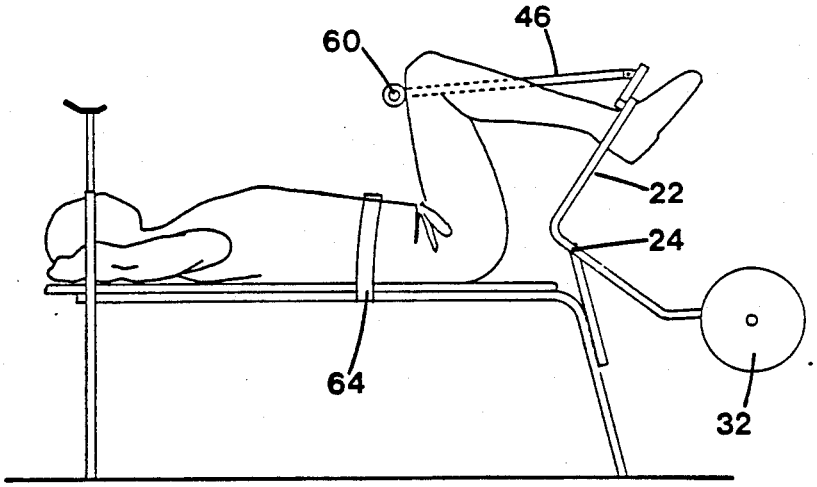

FIGS. 3 and 4 of the accompanying drawings show the use of the bench in a leg raise type of exercise. In FIG. 3, the user is shown lying supine on the bench top 12 with the waist belt 64 strapped around his waist. The legs are raised slightly, with the padded crossbar 60 resting on the legs, just above the knee. In performing the exercise, the legs are raised about the hips as illustrated in FIG. 4. This applies tension to the link 46 and pivots the arms 22 about their pivot pins 24 to raise the weights 32. This exercise is specifically directed at the development of the stomach muscles. The waist belt 64 retains the back on the bench to keep the back from arching, which diminishes the exercise effect on the stomach muscles. It also prevents the back curvature that can lead to severe lower back pain. The belt is adjustable along the bench to accommodate persons of different statures.

Figure 5:
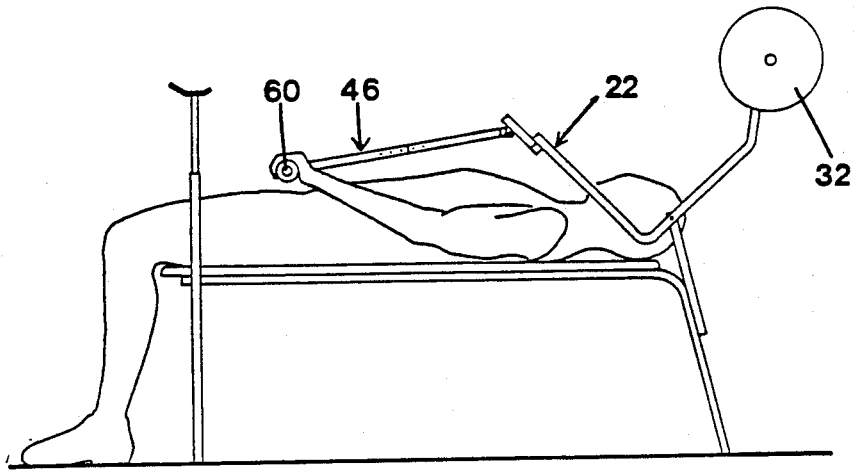
FIG. 5 is a schematic side elevation showing the use of the present invention with the arms.

FIG. 5 of the accompanying drawings illustrates the use of the attachment in arm pullover type of exercise where the user is again supine on the bench, but this time with the head towards the leg curl accessory. The ends of the crossbar 60 are grasped with the hands and pulled along the torso, again pivoting the arms 22 and raising the weights 32.

Figure 6:
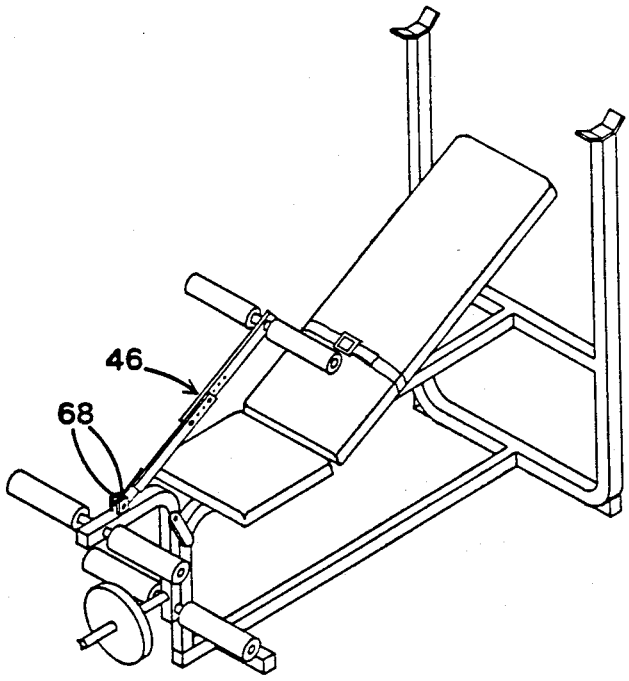
FIG. 6 is a detail view showing an alternative use of the invention with a single arm leg curl accessory.

FIG. 6 illustrates the attachment of the tension link and crossbar assembly to a bench with a single arm leg curl attachment, centrally located at the end of the bench. In this case, the tension link is connected to a pair of lugs 68 that project vertically from the single central arm. An apparatus of this sort cannot be used for the arm pullover exercise of FIG. 5, but it functions in the same way for stomach exercising.

While particular embodiments of the present invention have been described in the foregoing, it is to be understood that other embodiment are possible within the scope of the invention. The invention is to be construed as limited solely by the scope of the appended claims.

I claim:

1. An exercise apparatus comprising:

a bench;

at least one L-shaped arm pivotally mounted on an end of the bench for pivotal movement about a lateral arm axis between a rest position with a first part of the arm projecting substantially horizontally from the end of the bench and a second part of the arm projecting downwardly therefrom, and an elevated position in which the first part of the arm projects upwardly from the bench and the second part projects from the end of the bench;

means connected to the second part of the arm for resisting the upward pivoting movement of the arm;

a tension link connected to the first part of the arm at a single position spaced from the end of the bench for free pivotal movement with respect to the arm, the link being otherwise unconnected to the apparatus; and a link crossbar connected to the link remote from its connection to the arm.

2. An exercise apparatus according to claim 1 wherein the tension link is a bar.

3. An exercise apparatus according to claim 1 wherein the tension link is adjustable in length.

4. An exercise apparatus according to claim 3 wherein the tension link comprises a pair of bars and means for connecting the bars together at various positions to adjust the spacing between the link crossbar and the connection between the link and the arm.

5. An exercise apparatus according to claim 1 wherein the link crossbar is padded.

6. An exercise apparatus according to claim 1 including a belt attached to the bench for restraining the waist of a user against the bench.

7. An exercise apparatus according to claim 1 including two arms positioned at opposite sides of the bench with an arm crossbar extending between the arms and the tension link connected to the arm cross bar.

8. An exercise apparatus according to claim 7 wherein the arm crossbar has a centre section that is offset away from the end of the bench, the tension link being connected to the offset section.

9. An exercise apparatus according to claim 1 including a single arm position centrally of the end of the bench, the end of the tension link being connected directly to the arm.

10. An exercise apparatus comprising:

a bench;

an L-shaped arm pivotally mounted intermediate its ends to an end of the bench for pivotal movement about a lateral arm axis between a rest postition in which a first part of the arm projects substantially horizontally from the end of the bench and a second part projects downwardly, and an elevated position in which the first part of the arm projects upwardly from the bench and the second part projects from the end of the bench;

means for mounting weights on the second part of the arm;

a tension link;

means for detachably connecting the tension link directly to the first part of the arm for free pivotal movement about a lateral link axis spaced from the arm axis, the tension link being otherwise unconnected to the apparatus;

a crossbar connected to the link at a position spaced from the link axis.

11. An apparatus according to claim 10 including a belt connected to the bench for restraining the waist of a user against the bench.

12. An exercise apparatus comprising:

a bench;

a pair of L-shaped arms, each pivotally mounted intermediate its ends to a respective side of the bench, at an end thereof, for pivotal movement of the arms about a common lateral arm axis between an at rest position in which a first part of each arm projects substantially horizontally from the end of the bench and a second part of each arm projects downwardly, and an elevated position in which the first part of each arm projects upwardly from the bench and the second part projects from the end of the bench;

means for mounting weights on the second part of the arms;

a tension link;

means for detachably connecting the tension link directly to the first parts of the arms for free pivotal movement about a lateral link axis spaced from the arm axis, the tension link being otherwise unconnected to the apparatus;

a crossbar connected to the link at a position spaced from the link axis.

* * * * *